US006122871A

United States Patent [19]

Russell et al.

[11] Patent Number: 6,122,871

[45] Date of Patent: Sep. 26, 2000

[54] WALL-TO-CEILING STRUCTURE INCLUDING FRAMEWORK AND COVER PANEL

[75] Inventors: Scott H. Russell, Kalamazoo; Allen C. Hager, Grand Rapids; David J. Battey, Kentwood, all of Mich.

[73] Assignee: Steelcase Development Inc., Grand Rapids, Mich.

[21] Appl. No.: 09/195,938

[22] Filed: Nov. 19, 1998

[51] Int. Cl.[7] ..... E04B 2/74; E04B 2/82

[52] U.S. Cl. ..... 52/243.1; 52/126.3; 52/241; 52/481.2

[58] Field of Search ..... 52/67, 126.3, 241, 52/243.1, 481.2

[56] References Cited

U.S. PATENT DOCUMENTS

| | | | |
|---|---|---|---|
| 1,716,624 | 6/1929 | Dawson . | |
| 2,078,491 | 4/1937 | Graham . | |
| 2,159,296 | 5/1939 | Sharp . | |
| 2,304,423 | 12/1942 | Schiller . | |
| 2,766,855 | 10/1956 | Johnson et al. . | |
| 3,066,770 | 12/1962 | Millard et al. . | |
| 3,608,266 | 9/1971 | Satkin et al. | 52/126.3 X |
| 3,774,360 | 11/1973 | Hubbard et al. . | |
| 4,086,734 | 5/1978 | Hayashi . | |
| 4,103,463 | 8/1978 | Dixon . | |
| 4,277,920 | 7/1981 | Dixon . | |
| 4,361,994 | 12/1982 | Carver . | |
| 4,450,658 | 5/1984 | Legeai | 52/126.3 X |
| 4,454,690 | 6/1984 | Dixon . | |
| 4,709,517 | 12/1987 | Mitchell et al. . | |
| 4,757,657 | 7/1988 | Mitchell et al. . | |
| 4,787,767 | 11/1988 | Wendt . | |
| 4,825,610 | 5/1989 | Gasteiger . | |
| 4,905,428 | 3/1990 | Sykes . | |
| 4,914,880 | 4/1990 | Albertini . | |
| 5,038,534 | 8/1991 | Pollock . | |
| 5,062,246 | 11/1991 | Sykes . | |
| 5,146,723 | 9/1992 | Greenwood et al. . | |
| 5,159,793 | 11/1992 | Deugo et al. . | |
| 5,471,805 | 12/1995 | Becker . | |
| 5,524,402 | 6/1996 | Sykes . | |
| 5,560,149 | 10/1996 | Lafevre . | |
| 5,755,066 | 5/1998 | Becker | 52/243.1 X |

*Primary Examiner*—Christopher T. Kent
*Attorney, Agent, or Firm*—Price Heneveld Cooper Dewitt & Litton

[57] ABSTRACT

An apparatus includes a ceiling channel, an elongated transom frame member, and an adapter configured to mateably engage both the ceiling channel and the transom frame member. Specifically, the adapter includes an upper end with horizontal and angled flanges shaped to engage mating wall sections on the ceiling channel, in a manner providing stability to the connection and also providing alternative attachment sites for receiving a screw fastener. A lower end of the adapter telescopingly engages a top end of the frame member, and includes a pair of spaced-apart flanges and a spreader screw that can be adjusted to flex the flanges and frictionally bind the flanges against mating wall sections on the transom frame member in a selected telescoped position on the frame member. The ceiling channel has down flanges defining a longitudinally extending recess for receiving an upper edge of a cover panel. Safety clips attached to the upper edge of the cover panel engage the ceiling channel. The safety clips have a flexible protruding member that moves to a non-interfering depressed position when the upper edge extends into the recess, but that moves to an extended position when the upper edge drops out of the recess. By this arrangement, the cover panel is retained to the ceiling channel, even when a catastrophic event occurs causing the upper edge of the cover panel to drop out of engagement with the ceiling channel.

28 Claims, 5 Drawing Sheets

WALL-TO-CEILING STRUCTURE INCLUDING FRAMEWORK AND COVER PANEL

BACKGROUND OF THE INVENTION

The present invention concerns an apparatus for covering the space above a partition up to a ceiling including a sub-frame and a cover panel, each configured to mateably engage a ceiling channel.

Consumers often desire the additional visual and acoustic privacy obtained by extending a partial-height wall or free-standing partition to a building ceiling. Attachment of a freestanding partition to a ceiling can also provide added stability to the partition. However, difficulties are encountered when designing a support structure and cover panel for this purpose. For example, floors and ceilings are often not flat or level. Further, partitions are usually vertically adjustable so that they can be adjusted to a level condition on a floor. As a result, the dimension from a top of the partition (or wall) to the ceiling varies unpredictably. Accordingly, any apparatus for attachment above a partition up to a ceiling must be flexible enough to deal with these problems. Also, installation can be difficult because the attachment to the ceiling must be done while standing on a ladder or on a platform, and/or must be done while leaning over an existing wall or partition. These problems of non-uniformity and imperfect levels cause designs to become complex and/or to incorporate a large number of pieces and/or to require customization at the job site. However, complexity, multiplicity of parts, and/or on-site customization raise inventory and labor costs and create part management problems. Also, they cause problems when reconfiguring and rearranging a partition arrangement.

Where possible, it is desirable to make the connection to the ceiling a rigid one that is strong enough to withstand torsional forces, so that the connection itself not only anchors the partition to the ceiling, but also stabilizes the partition independent of the floor. However, this tends to result in stiff, heavy parts, which is undesirable.

In addition to the above, it is desirable to provide a partition-to-ceiling connection and covering arrangement that is resistant to coming apart when stressed by a catastrophic event, such as an earthquake. Further, it is desirable to have cover panels that can be cut in the field where necessary, yet that still provide a high quality appearance and a good tight fit.

Accordingly, an apparatus solving the aforementioned problems and having the aforementioned advantages is needed.

SUMMARY OF THE INVENTION

In one aspect of the present invention, an apparatus includes a ceiling channel and a transom frame assembly with a lower end adapted for securement to a partition and an upper end mateably engaging the ceiling channel. The ceiling channel has a first wall section and at least one second wall section obliquely angled relative to the first wall section. The upper end has a first flange and at least one second flange obliquely angled relative to the first flange, with the first and second flanges abuttingly engaging the first and second wall sections, respectively. A fastener secures one of the first and second flanges to an associated one of the first and second wall sections, with the first and second flanges engaging the first and second wall sections, respectively, to stabilize the frame assembly on the ceiling channel.

In another aspect of the present invention, an apparatus includes a ceiling channel, a transom frame member, and an adapter for interconnecting the frame member to the ceiling channel. The frame member has a bottom end adapted to be secured to a partition and has a top end having spaced-apart first and second wall sections. The adapter includes an upper end mateably engaging the ceiling channel, and further includes a lower end telescopingly engaging the top end of the frame member, with the lower end including spaced-apart first and second flanges configured to closely but slidingly engage the first and second wall sections. At least one securing device is configured to flex the first and second flanges into frictional binding engagement with the first and second wall sections to hold the adapter in a selected telescoped position on the frame member.

In another aspect of the present invention, an apparatus includes a ceiling channel having a down flange defining an outer boundary of a longitudinally extending recess. A cover panel has an upper edge shaped to fit mateably into the recess. A protruding member on the cover panel extends above the upper edge. By this arrangement, the cover panel is retained to the ceiling channel, even when a catastrophic event occurs causing the upper edge of the cover panel to drop out of engagement with the ceiling channel. In a narrower aspect, the protruding member is resilient and is configured to move to a non-interfering depressed position when the upper edge extends into the recess, but configured to move to an upwardly extended position when the upper edge drops out of the recess. In another narrower aspect, a clip attached to the cover panel includes the protruding member.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
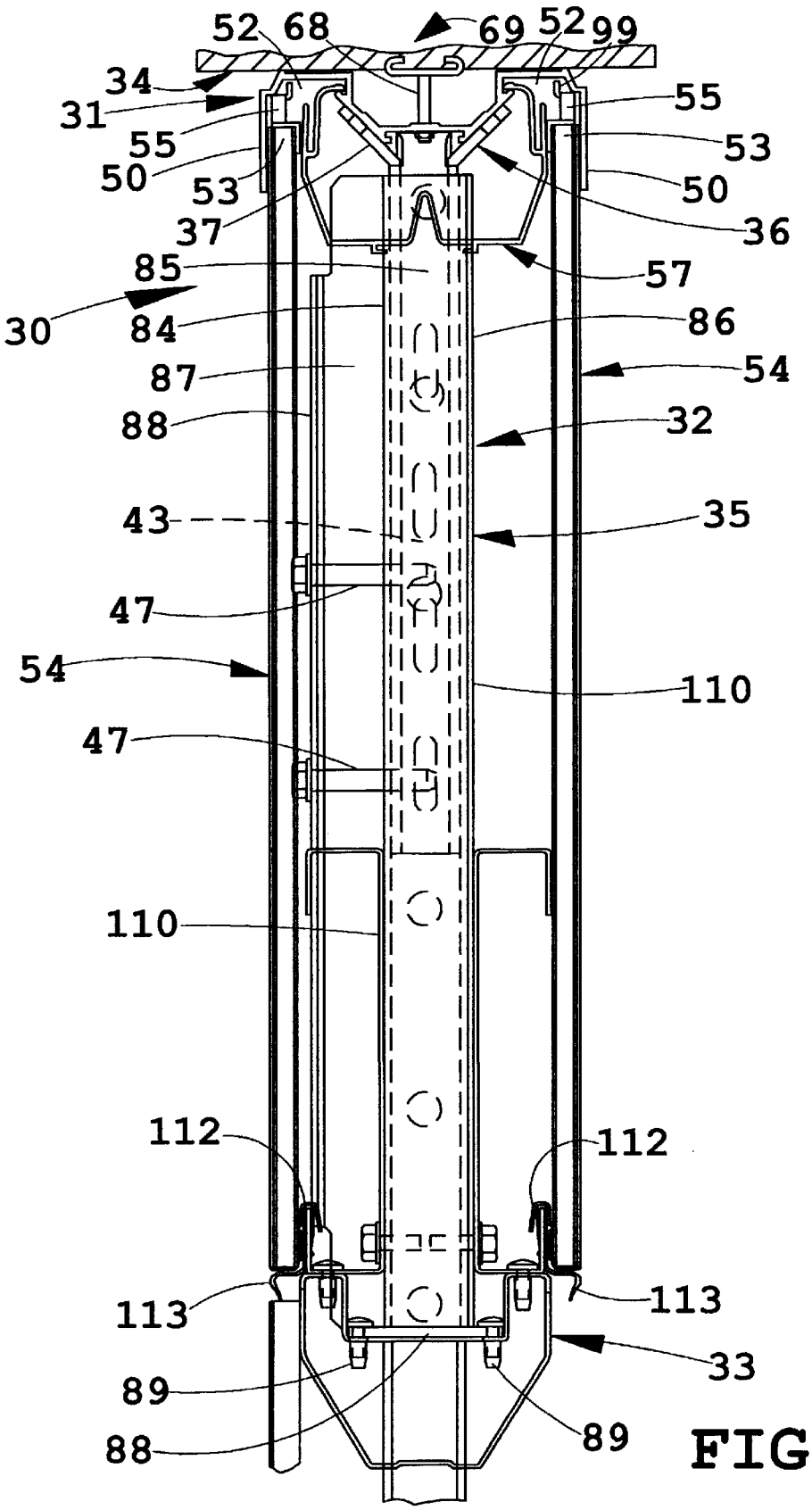
FIG. 1 a cross-sectional elevational view of a transom apparatus embodying the present invention.

An apparatus 30 (FIG. 1) embodying the present invention includes a ceiling channel 31 and a transom frame assembly 32 for connecting a partition 33 to a building ceiling 34, such as a drop ceiling. The transom frame assembly 32 includes an elongated transom frame member 35, and an adapter 36 configured to mateably engage both the ceiling channel 31 and the transom frame member 35. More specifically, the adapter 36 includes an upper end 37 that mates with the ceiling channel 31 in a manner providing alternative attachment sites, thus facilitating assembly in tight quarters, and further mates to provide a rigid and stable connection that improves the overall stability of the arrangement. The adapter 36 also includes a lower end 43 having a cross section shaped to telescopingly engage the frame member 35 for adjustment, but that can be expanded to frictionally secure the lower end 43 in a selected adjusted position. A cover panel 54 includes an upper edge 53 that fits into a recess 52 in the ceiling channel 31, and a protruding safety clip 55 is attached to the upper edge 53 to retain the cover panel 54 in the recess 52, even where the upper edge 53 drops out of engagement with the recess 52.

Figure 2:
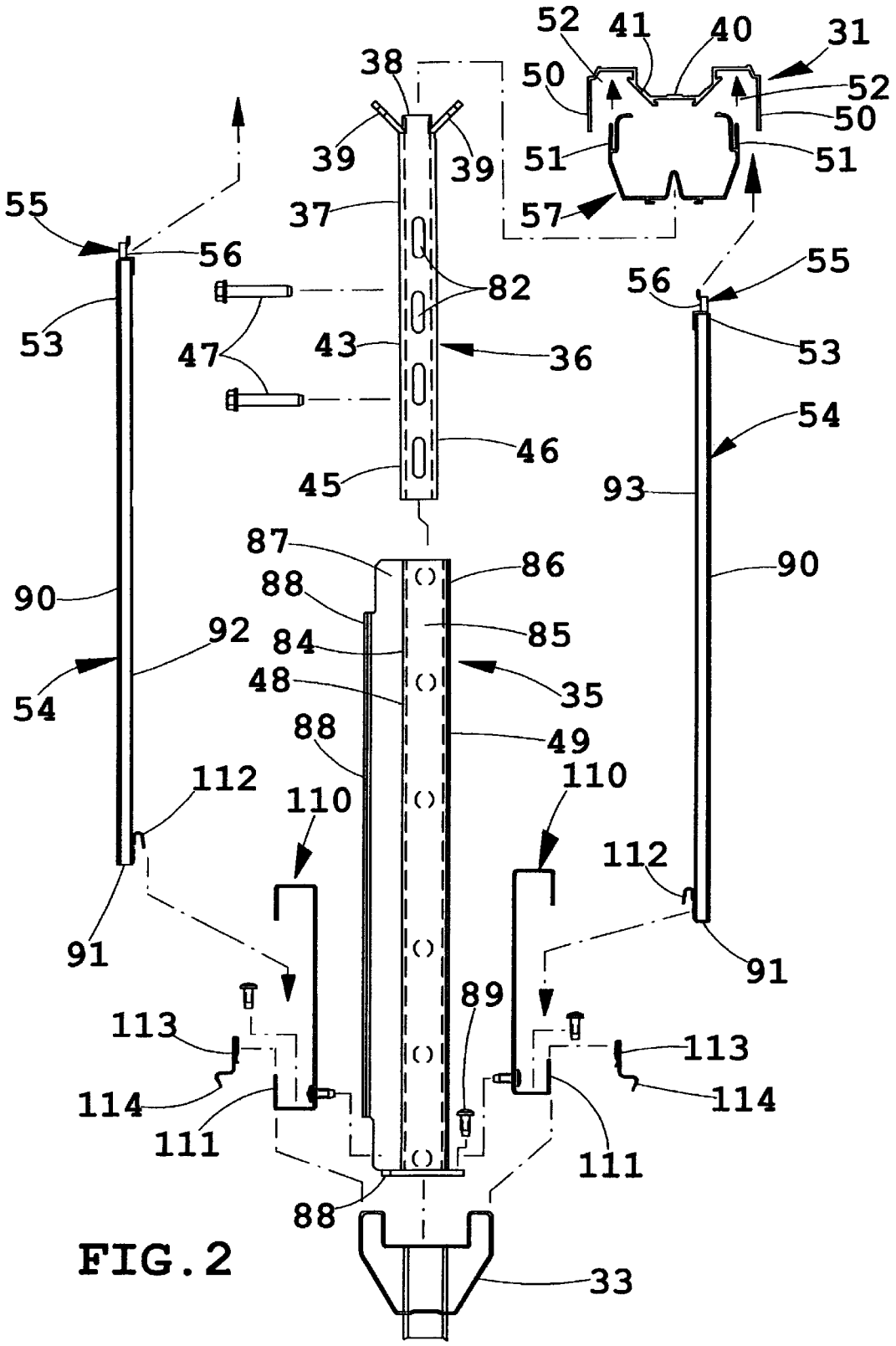
FIG. 2 is an exploded view of FIG. 1.

More specifically, the upper end 37 (FIG. 2) of adapter 36 has horizontal and angled flanges 38 and 39 shaped to engage mating wall sections 40 and 41 on the ceiling channel 31. The horizontal and angled flanges 38 and 39 form a concave shape that, when secured in place, provides stability to the connection in a side-to-side direction and in a horizontal direction perpendicular to the side-to-side direction. The multiple flanges 38 and 39 also provide alternative attachment sites for receiving one or more screw fasteners 42. As one skilled in the art will recognize, the more screw fasteners 42 that are installed, the more stable the connection. Nonetheless, the arrangement is surprisingly secure with only a single screw securing it in place. The lower end 43 of the adapter 36 includes a pair of spaced-apart flanges 45 and 46. One or more spreader screws 47 threadably engage one of the flanges 45 and 46, with the free end of the screw 47 abutting the other flange 45 or 46. By turning the screw 47, it flexes the flanges 45 and 46 apart, causing them to frictionally bind the flanges 45 and 46 against mating wall sections 84 and 86 on the transom frame member 35 in a selected telescoped position on the frame member 35.

The illustrated ceiling channel 31 (FIG. 2) has a pair of down flanges 50 at its side edges. A cover panel spacer 57 attached to the ceiling channel 31 has side flanges 51 on each side that define, with the down flanges 50, a pair of longitudinally extending recesses 52 for receiving the upper edge 53 of a transom cover panel 54. The safety clips 55 are releasably snap attached to the upper edge 53 of the cover panel 54 and are shaped to engage one of the recesses 52 of the ceiling channel 31. The safety clips 55 have a flexible protruding member 56 that flexibly moves (if it strikes the ceiling channel 31) to a non-interfering depressed position when the upper edge 53 is extended into the recess 52, but that flexibly moves to an extended position when the upper edge 53 drops out of the recess 52. By this arrangement, the cover panel 54 is retained to the ceiling channel 31, even when a catastrophic event occurs causing the upper edge 53 of the cover panel 54 to drop out of engagement with the ceiling channel 31.

Figure 7:
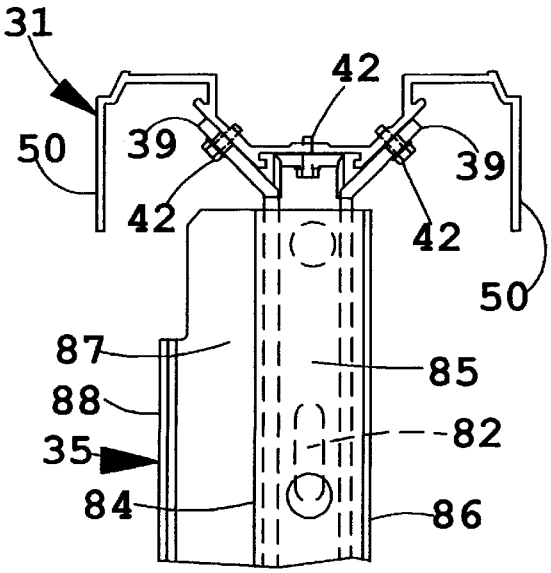
FIG. 7 is an end view of the frame assembly of FIG. 5 engaged with the ceiling channel of FIG. 3.
Figure 8:
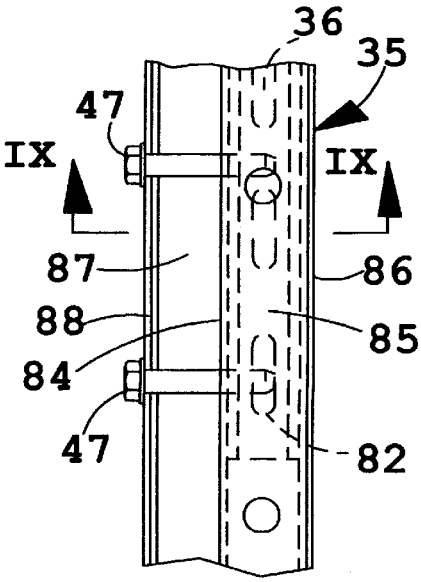
FIG. 8 is a fragmentary side elevational view of the frame assembly shown in FIG. 1.

The illustrated ceiling channel 31 (FIG. 3) is an extrusion that includes ceiling-adjacent wall sections 59 and 60 connected together by a transverse concave wall section 61. The wall sections 59 and 60 include ridges 59' and 60' that engage the ceiling 34. The transverse concave wall section 61 includes down wall sections 62 and 63, angled wall sections 41, and the horizontal wall section 40. The angled wall sections 41 each include a protruding upper end 64 that forms a recess 65 for retaining the cover panel spacer 57. The angled wall sections 41 each also include a protruding lower end 66 that forms a recess 67 for receiving a blade-like in-line connector (not shown) for connecting aligned ceiling channels 31 in a perfectly aligned position. The horizontal wall section 40 is thickened somewhat from the remaining wall sections, such that it is particularly adapted to receive a screw, such as the adapter-retaining screw 42 (FIG. 7) or the screw 68 for the ceiling-retaining bracket 69 (FIG. 1). The down flanges 50 (FIG. 3) extend downwardly from the outer edges of the ceiling-engaging wall sections 59 and 60. A recess 70 can be included at the corner formed adjacent the ceiling 34 for aesthetics, if desired.

Figure 3:
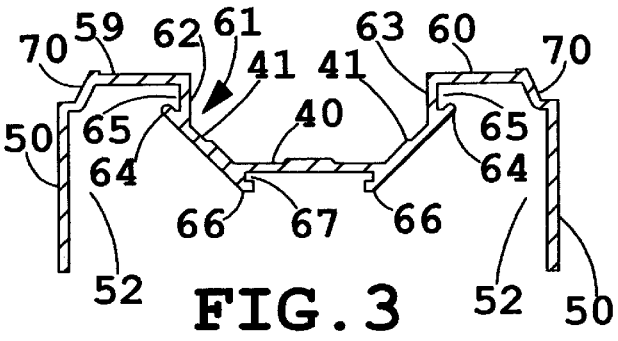
FIG. 3 is a cross-sectional view of the ceiling channel shown in FIG. 1.
Figure 10:
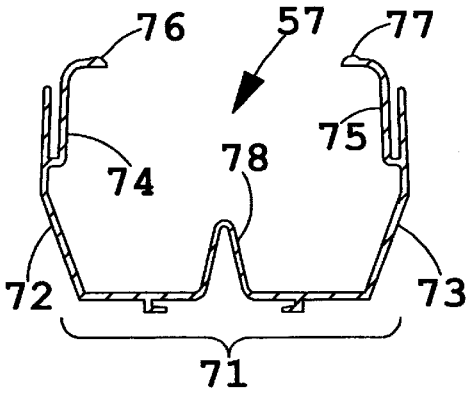
FIG. 10 is an enlarged cross-sectional view of the cover panel spacer shown in FIG. 1.

The spacer 57 (FIG. 10) is a polymeric extrusion cut into short lengths about 2 to 6 inches long and optimally about 2.75 inches long. A plurality of the spacers 57 are snapped onto and spaced longitudinally along the ceiling channel 31, with enough of the spacers 57 being used to press the cover panels 54 outwardly against the down flanges 50 (FIG. 1). The spacers 57 (FIG. 10) each include a transverse section 71 with a pair of up flanges 72 and 73 at each end. A pair of L-shaped legs 74 and 75 extend upwardly from a midpoint of the up flanges 72 and 73, each including an enlarged end 76 and 77 forming a detent for engaging the recesses 65 (FIG. 3). An inverted U-shaped flexible zone 78 is formed in the center of transverse section 71. The thickness of the various sections, flanges, and legs of spacer 57 in combination with the flexible zone 78 allow the spacer 57 to be snap attached onto a bottom of the ceiling channel 31. When so attached, the up flanges 72 and 73 form the recesses 52 with the down flanges 50 on ceiling channel 31 for receiving the upper edge 53 of the cover panels 54 (FIG. 1). The up flanges 72 and 73 are flexible, such that they press the cover panels 54 outwardly against the down flanges 50 of the ceiling channel 31.

Figure 4:
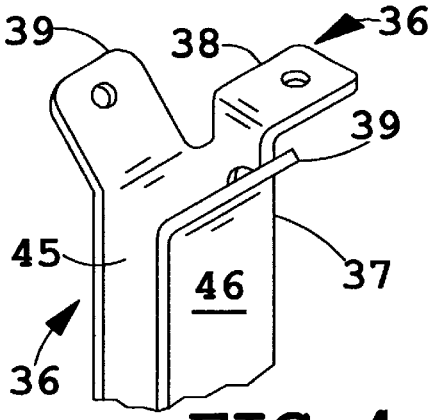
FIG. 4 is a fragmentary perspective view of an upper end of the adapter shown in FIG. 1.

The upper end 37 of adapter 36 (FIG. 4) includes a single horizontal flange 38 and a pair of the angled flanges 39, which form a concave shape having a "rosebud" like appearance. The horizontal flange 38 is configured to fit flat against the wall section 40 of ceiling channel 31 (FIG. 3), between the ends 66 of the angled wall sections 41, with the angled flanges 39 fitting abuttingly against the angled wall sections 41. Flanges 38 and 39 each have holes for receiving a screw. Attachment screws 42 (FIG. 7) can be selectively extended through any one of or all of the flanges 38 and 39. The arrangement is very stable, even when using only a single screw due to the "dovetail" like mating engagement, and of course is even more stable when multiple screws are used. Notably, the angled flanges 39 have a face oriented downwardly and outwardly, such that it is relatively easy to position a power screwdriver or other tool perpendicularly to the angled flanges 39 to drive the screws 42. It is contemplated that in a "normal" installation, a single screw 42 will be driven vertically into the horizontal flange 38, but where space is limited or the installation is otherwise difficult due to limited clearances and tight quarters, the angled flanges 38 provide an alternative attachment site that can be used.

Figure 5:
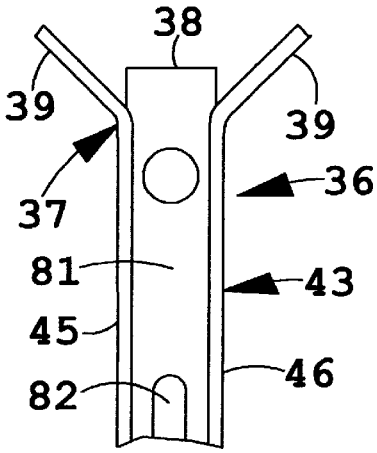
FIGS. 5 and 6 are fragmentary side elevational views of an upper end of the adapter shown in FIG. 4.
Figure 6:
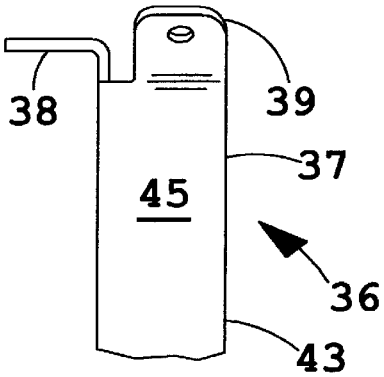
Figure 9:
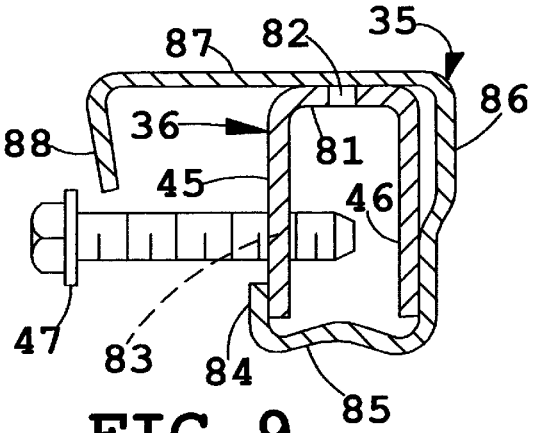
FIG. 9 is a cross-sectional view taken along line IX—IX in FIG. 8.

The lower end 43 (FIG. 5) of the adapter 36 has a U-shaped cross section, and includes a transverse flange 81 that interconnects the side flanges 45 and 46. The transverse flange 81 includes a plurality of longitudinally extending slots 82. Pairs of threaded holes 83 (FIG. 9) are located in each side flange 45 and 46 for receiving the spreader screws 47, so that the spreader screws 47 can be inserted from either side. When the screws 47 are turned, the ends of the screws 47 abut the opposite flange, forcing the flanges 45 and 46 apart. The slots 82 cause the flexing to occur primarily in transverse flange 81, and further cause the flexing to occur uniformly along the transverse flange 81. This results in a better and more secure connection of the adapter 36 to the frame member 35, as described below.

The frame member 35 (FIG. 2) is elongated and generally tubularly shaped. It is contemplated that the frame member 35 could be a tube, although the illustrated frame member 35 does not form a closed tube. Instead, the illustrated frame member 35 has a G-shaped cross section (FIG. 9), including, from inside to outside, orthogonally related wall sections 84–88. The wall sections 84–88 are shaped to mateably receive the U-shaped lower end 43 of adapter 36, with the transverse flange 81 abutting the wall 87, and with the side flanges 45 and 46 being located inside of wall sections 84 and 86. The ends of side flanges 45 and 46 are located near wall section 85. The side flanges 45 and 46 slidingly engage the wall sections 84 and 86, such that the adapter 36 can be telescoped into and out of the frame member 35. However, when the spreader screws 47 are turned to spread apart the side flanges 45 and 46, the side flanges 45 and 46 frictionally engage the wall sections 84 and 86 to form a very secure and solid connection. The bottom of the illustrated frame member 35 includes an attachment bracket or plate 88 (FIG. 2) configured for stiff and rigid interconnection to a top of the partition 33 by screws 89. Alternative bottom connection arrangements are also believed to be within the scope of the present invention.

Figure 11:
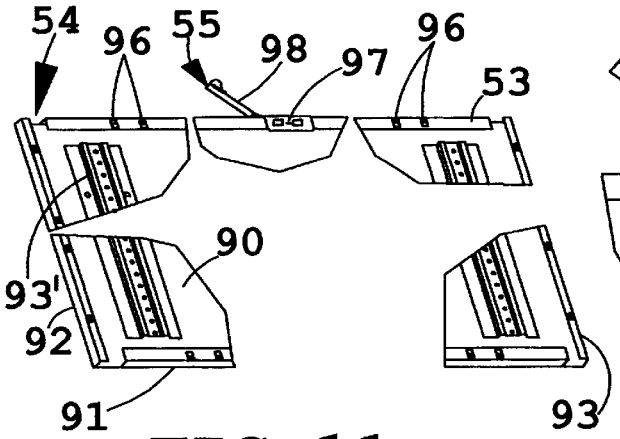
FIG. 11 is a fragmentary perspective view of the cover panel shown in FIG. 1.
Figure 12:
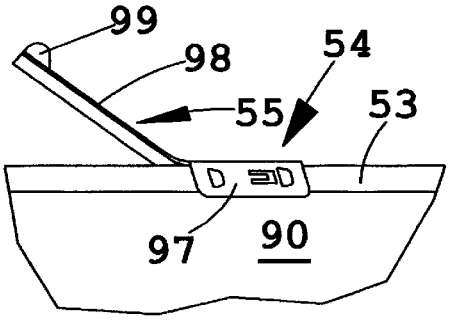
FIG. 12 is a perspective view of an upper edge of the cover panel shown in FIG. 1, including the safety clip attached thereto.
Figure 14:
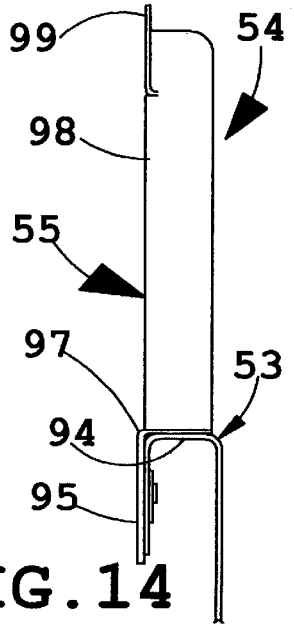
Figure 15:
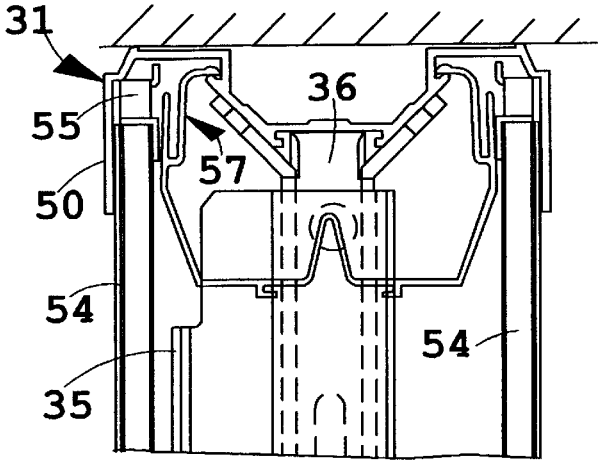
FIGS. 15 and 16 are fragmentary end views similar to an upper part of FIG. 1, with FIG. 15 showing the upper edge of the cover panel fully engaged in a cover-receiving recess in the ceiling channel, and with FIG. 16 showing the upper edge dropped below the cover-receiving recess, but with the safety clip still engaged with the recess.

It is contemplated that the scope of the present invention is broad enough to cover any type of cover panel material or configuration, including wood, composite, plastic, and other materials. Nonetheless, the illustrated cover panel 54 is shown for the purpose of describing the present invention. The cover panel 54 (FIG. 11) includes a flat sheet metal panel 90 covered with upholstery material, with folded edges forming the upper edge 53, and also forming the bottom and side edges 91–93. The folded edges 53 and 91–93 stiffen the cover panel 54, but additional stiffeners 93' can be adhered or attached to a back of the panel 90 as needed. The upper edge 53 includes a flat top portion 94 (FIG. 14) and a down portion 95. The down portion 95 includes several pairs of apertures 96 for supporting the clip 55, as discussed below.

In the illustrated arrangement, a pair of C-shaped transom wire management channels 110 are attached to a top of the partition 33 and to the side of the transom frame member 35. The channels 110 can be cut short of the transom frame member 35 or can be notched to avoid an interference problem. A bottom lip 111 on the channels 110 provides a location for engaging an attachment clip 112 on the bottom of the cover panel 54. The illustrated clip 112 extends a full length of the cover panel 54, less a couple inches on each end. However, it is noted that shorter sections or discrete "point-attached" clips can be used. A light seal 113 can also be attached to the lip 111, with a flexible tail 114 extending below the cover panel 54.

Figure 13:
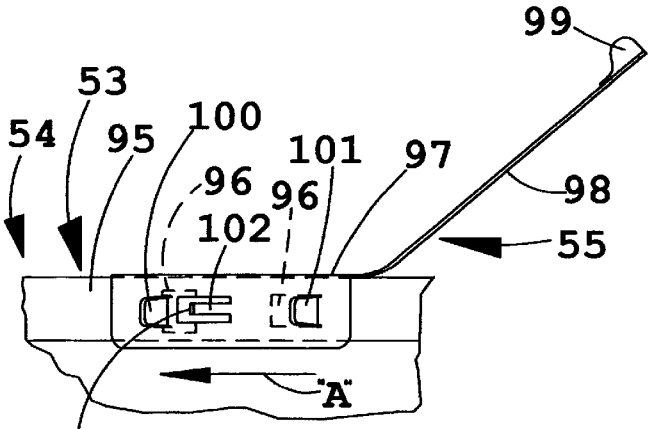
FIGS. 13 and 14 are side and end views, respectively, of the upper edge and safety clip shown in FIG. 12.
Figure 16:
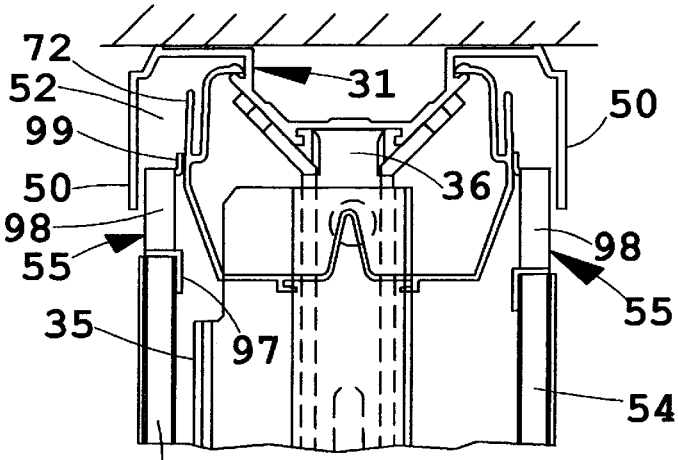

The safety clip 55 (FIG. 13) includes a cover engaging L-shaped body 97 and a resilient arm 98 that extends upwardly at an angle to the body 97. The illustrated clip 55 is made from spring steel, such that arm 98 is resiliently flexible. It is contemplated that other materials can be used for clip 55, such as plastic or the like. A tab 99 on the end of the arm 98 provides a flat surface that slidably engages an outboard surface on the up flanges 72 or 73 on the spacer 57 (see FIG. 16). The L-shaped body 97 (FIG. 13) fits mateably against the top and down portions 94 and 95. The down portion 95 includes first and second angled tabs 100 and 101 that slip into the apertures 96 from direction "A" and that engage a hidden undersurface of the down portion 95. A resilient interlock tab 102 extends from the body 97 and includes a hooked end 102' that snappingly engages one of the apertures 96 to prevent the clip 55 from accidentally being jarred loose by moving in a direction opposite to direction "A," thus preventing the tabs 100 and 101 from disengaging. The arm 98 extends above the cover panel 54, such that the upper edge 53 is retained in recess 52 of the ceiling channel 31, and stays retained even when a catastrophic event occurs causing the upper edge 53 of the cover panel 54 to drop out of engagement with the ceiling channel 31, as long as the cover panel 54 is high enough for the arm 98 to stay within the recess 52.

Figure 18:
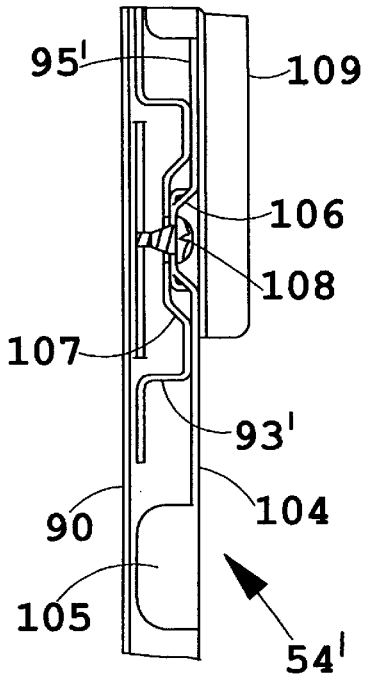
FIGS. 18 and 19 are cross-sectional views taken along the lines XVIII—XVIII and XIX—XIX in FIG. 17.
Figure 19:
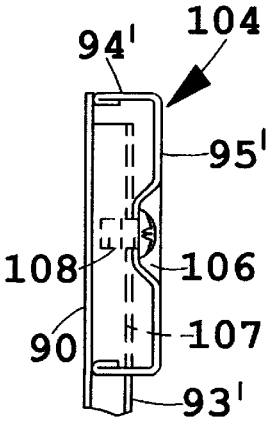
Figure 17:
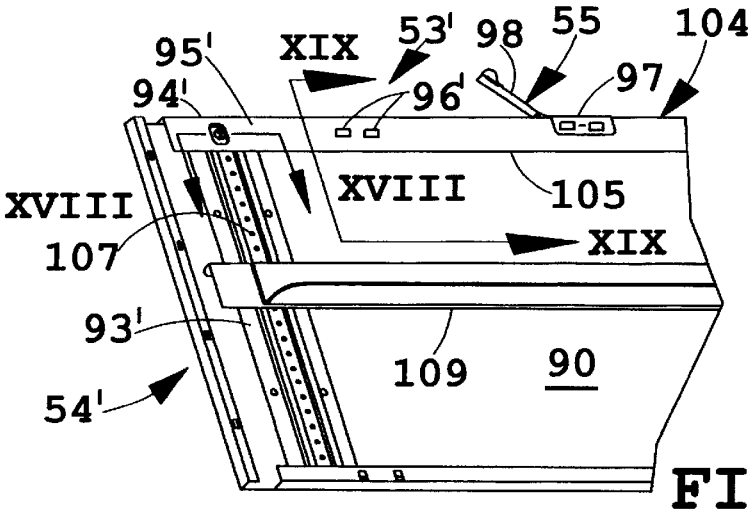
FIG. 17 is a fragmentary perspective view of a back surface of the cover panel shown in FIG. 11, but with the upper edge field cut and including a stiffening bracket attached to the "new" upper edge.

The cover panel 54 (FIG. 17) can be field cut to form a modified cover panel 54' having a vertical dimension that is less than the vertical dimension of cover panel 54. This allows the cover panel 54' to be fit into a space that corresponds to any adjusted position of the transom frame assembly 32, even though the smaller vertical dimension was not known ahead of the installation. In the modified cover panel 54', one or more inches of material is cut off the upper edge 53, thus forming a new "rough" upper edge 53'. A supplemental stiffener 104 is positioned along the new upper edge 53'. The supplemental stiffener 104 has an outwardly facing U-shaped cross section, and includes top and down portions 94' and 95' that replicate the "original" top and down portions 94 and 95. The supplemental stiffener 104 further includes a bottom portion 105 that engages a back surface of the panel 90 to keep the down portion 95' parallel to and spaced from the panel 90. The down portion 95' includes apertures 96' for supporting the safety clip 55. Depressions 106 (FIGS. 18 and 19) are formed in the down portion 95' at a location so that they fit into a longitudinally extending channel 107 in the original stiffeners 93', thus helping to locate the supplemental stiffener 104. A screw 108 is threaded into the depressions 106 and into the channels 107 to retain the supplemental stiffener 104 to the field-cut cover panel 54'. Adhesive and other attachment means can also be used to secure the supplemental stiffener 104 to the field-cut cover panel 54'. Notably, the clips 55 can be salvaged by removing them from the original cover panel 54 (i.e., by disengaging the interlock tab 102), and by reattaching them to the supplemental stiffener 104 on the modified cover panel 54'. Additional stiffeners 109 (FIG. 17) can be added to a back of the cover panel 54', if desired.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An apparatus comprising:

a ceiling channel;

a transom frame assembly including a lower end adapted for securement to a partition and an upper end mateably engaging the ceiling channel;

the ceiling channel having a first wall section and at least one second wall section obliquely angled relative to the first wall section, and the upper end having a first flange and at least one second flange obliquely angled relative to the first flange, the first and second flanges abuttingly engaging the first and second wall sections, respectively; and a fastener securing one of the first and second flanges to an associated one of the first and second wall sections, with the first and second flanges engaging the first and second wall sections, respectively, to stabilize the frame assembly on the ceiling channel.

2. The apparatus defined in claim 1 wherein the fastener comprises a screw, and wherein the second flange is oriented, so that the screw can be driven perpendicularly into the second flange by a screw driving tool located at a position generally adjacent the transom frame assembly, but that is characteristically not located directly under a center of the ceiling channel.

3. The apparatus defined in claim 2 wherein the oblique angle of the second flange is about 45 degrees.

4. The apparatus defined in claim 1 wherein the at least one second flange includes a pair of second flanges that are angled in opposite directions with respect to a centerline of the ceiling channel.

5. The apparatus defined in claim 4 wherein the first-mentioned fastener engages one of the pair of second flanges, and including a second fastener engaging the other of the pair of second flanges.

6. The apparatus defined in claim 1 wherein the transom frame assembly includes an elongated frame member, and further includes an adapter that both telescopingly engages the frame member and also that includes the first flange and the at least one second flange.

7. The apparatus defined in claim 6 wherein the adapter includes a lower portion having a first pair of spaced-apart flanges, and the frame member includes a pair of spaced-apart wall sections shaped to closely receive the first pair of spaced-apart flanges, and includes a spreader screw operably attached to the first pair of spaced-apart flanges for biasing the spaced-apart flanges away from each other and into frictional contact with the pair of spaced-apart wall sections.

8. The apparatus defined in claim 1 wherein the ceiling channel includes a down flange defining one side of a recess under the ceiling channel, and including a spacer defining another side of the recess, and further including a cover panel shaped to partially cover the transom frame assembly, the cover panel including an upper edge that fits mateably between the spacer and the down flange into the recess.

9. The apparatus defined in claim 1 wherein the ceiling channel includes a down flange defining one side of a recess under the ceiling channel, and including a cover panel shaped to partially cover the transom frame assembly, the cover panel including an upwardly extending arm configured to engage the down flange and hold the cover panel on an inboard side of the down flange, even if an upper edge of the cover panel drops below a lower edge of the down flange.

10. The apparatus defined in claim 9 including a clip releasably attached to the upper edge of the cover panel, the clip including the upwardly extending arm.

11. An apparatus comprising:

a ceiling channel;

a transom frame member including a bottom end adapted to be secured to a partition and a top end having spaced-apart first and second wall sections;

an adapter including an upper end mateably engaging the ceiling channel and a lower end telescopingly engaging the top end of the frame member, the lower end including spaced-apart first and second flanges configured to closely but slidingly engage the first and second wall sections; and at least one securing device configured to flex the first and second flanges into frictional binding engagement with the first and second wall sections to hold the adapter in a selected telescoped position on the frame member.

12. The apparatus defined in claim 11 wherein the lower end of the adapter has a U-shaped cross section that is defined in part by the first and second flanges.

13. The apparatus defined in claim 12 wherein the securing device includes a screw that threadably engages one of the first and second flanges, and that abuts the other one of the first and second flanges so that the screw, when turned, spreads the first and second flanges apart into binding frictional contact against the first and second wall sections.

14. The apparatus defined in claim 13 wherein the U-shaped cross section is defined in part by a third wall section that interconnects the first and second wall sections, the third wall section including longitudinally extending slots therein that cause the third wall section to flex along a line formed by the slots, so that flexing occurs primarily in the third wall section so that the first and second wall sections remain relatively flat.

15. The apparatus defined in claim 14 wherein the frame member defines an interior space shaped to closely receive the U-shaped cross section of the adapter.

16. The apparatus defined in claim 12 wherein the frame member has a G-shaped cross section.

17. An apparatus comprising:

a ceiling channel having a down flange defining an outer boundary of a longitudinally extending recess; and a cover panel having an upper edge shaped to fit mateably into the recess, the cover panel having a protruding member that extends above the upper edge, whereby the cover panel is retained to the ceiling channel, even when a catastrophic event occurs causing the upper edge of the cover panel to drop out of engagement with the ceiling channel.

18. The apparatus defined in claim 17 including a clip attached to the cover panel that includes the protruding member.

19. The apparatus defined in claim 18 wherein the protruding member includes a flexible arm that extends upwardly.

20. The apparatus defined in claim 19 wherein the flexible arm extends upwardly at an oblique angle to an upper edge of the cover panel.

21. The apparatus defined in claim 20 wherein the clip releasably snap attaches to the upper edge.

22. The apparatus defined in claim 21 wherein the clip snap attaches to the upper edge of the cover panel.

23. The apparatus defined in claim 17 wherein the protruding member includes a flexible arm that extends upwardly.

24. The apparatus defined in claim 17 including a spacer attached to the ceiling channel that includes a side flange defining an inboard side of the recess with the down flange of the ceiling channel, the upper edge of the cover panel and the clip extending into the recess.

25. The apparatus defined in claim 18 wherein the upper edge of the cover panel is defined by a rough field-cut edge and by a stiffener attached along the rough field-cut edge, the clip being attached to the stiffener.

26. An apparatus comprising:

a ceiling channel having a down flange defining an outer boundary of a longitudinally extending recess;

a spacer attached to the ceiling channel, the spacer including a side flange defining an inboard side of the recess;

a cover panel having an upper edge that fits mateably into the recess and that closely engages the down flange and the side flange; and a clip attached to the upper edge, the clip having an upwardly extending arm.

27. The apparatus defined in claim 26 wherein the arm is flexible and readily bendable, so that the arm flexes to a non-interfering position when the upper edge of the cover panel is pressed into the recess, but so that the arm flexes to an upright position when the upper edge drops below a lower edge of the down flange.

28. The apparatus defined in claim 26 including a plurality of spacers, the first-mentioned spacer being one of the plurality of spacers, the plurality of spacers being dimensionally short relative to the ceiling channel and positioned at spaced-apart locations longitudinally along the ceiling channel.

* * * * *